US006042656A

United States Patent [19]

Knutson

[11] Patent Number: 6,042,656

[45] Date of Patent: Mar. 28, 2000

[54] SHUTOFF CONTROL METHODS FOR SURFACE TREATING MACHINES

[75] Inventor: Kipp W. Knutson, Shorewood, Minn.

[73] Assignee: Nilfisk-Advance, Inc., Plymouth, Minn.

[21] Appl. No.: 08/953,133

[22] Filed: Oct. 17, 1997

[51] Int. Cl.[7] ..... A47L 5/00

[52] U.S. Cl. ..... 134/21; 134/6; 15/319; 15/50.1; 15/320

[58] Field of Search ..... 15/49.1, 50.1, 15/319, 320, 340.1, 340.3, 340.2, 389, 390; 96/158, 165, 406; 134/6, 21; 118/207

[56] References Cited

U.S. PATENT DOCUMENTS

| | | | |
|---|---|---|---|
| 3,424,964 | 1/1969 | Bacon . | |
| 3,426,259 | 2/1969 | Ziehm . | |
| 3,599,006 | 8/1971 | Harris . | |
| 3,668,485 | 6/1972 | Norris . | |
| 3,784,846 | 1/1974 | Krick et al. . | |
| 3,875,487 | 4/1975 | White . | |
| 4,100,466 | 7/1978 | Schroeder . | |
| 4,196,462 | 4/1980 | Pohl . | |
| 4,245,370 | 1/1981 | Baker | 15/319 |
| 4,443,906 | 4/1984 | Tucker et al. . | |
| 4,506,405 | 3/1985 | Block . | |
| 4,590,635 | 5/1986 | Tucker et al. . | |
| 4,633,541 | 1/1987 | Block . | |
| 4,652,802 | 3/1987 | Johnston . | |
| 4,667,364 | 5/1987 | Meili . | |
| 4,674,142 | 6/1987 | Meili . | |
| 4,675,935 | 6/1987 | Kasper et al. . | |
| 4,679,271 | 7/1987 | Field et al. . | |
| 4,736,116 | 4/1988 | Pavlak, Jr. et al. . | |
| 4,757,566 | 7/1988 | Field et al. . | |
| 4,825,500 | 5/1989 | Basham et al. . | |
| 4,879,623 | 11/1989 | Baumgartner et al. . | |
| 4,906,857 | 3/1990 | Cummins et al. . | |
| 4,997,639 | 3/1991 | Takahashi et al. | 15/319 |
| 5,177,828 | 1/1993 | Von Vett . | |
| 5,205,014 | 4/1993 | Yoo | 96/406 |
| 5,208,521 | 5/1993 | Aoyama . | |
| 5,279,672 | 1/1994 | Betker et al. . | |
| 5,298,080 | 3/1994 | Von Vett . | |
| 5,355,059 | 10/1994 | McMillan . | |
| 5,448,442 | 9/1995 | Farag . | |
| 5,449,988 | 9/1995 | Gurstein et al. | 15/319 |
| 5,698,957 | 12/1997 | Sowada . | |
| 5,893,195 | 4/1999 | Jung | 15/319 |

FOREIGN PATENT DOCUMENTS

| | | | |
|---|---|---|---|
| 5-146386 | 6/1993 | Japan | 15/319 |
| 6-105770 | 4/1994 | Japan | 15/319 |

OTHER PUBLICATIONS

M2700–ABA Automatic Burnishing System, Minuteman International, Illinois, Oct. 1997, 986740–20N (No Date).

*Primary Examiner*—Terrence R. Till
*Attorney, Agent, or Firm*—Alan Kamrath; Oppenheimer, Wolff & Donnelly, LLP

[57] ABSTRACT

An apparatus (200) is provided in a floor scrubber (10) for automatically shutting off the motor (60) which rotates an agitator (64) and the motor (96) of a vacuum assembly under various operating conditions of the floor scrubber (10). The current to the motors (60, 96) is detected by devices (204, 206) and monitored by a control circuit (202) controlling devices (208, 210 which interrupt operation of the motors (60, 96). In the preferred form, operation of the agitator (64) is interrupted when the current to the brush motor (60) is less than or equal to a threshold level indicating that the agitator (64) has been raised from the floor surface as the current to the brush motor (60) would be above the threshold level when the agitator (64) engages the floor surface. Operation of the vacuum assembly is interrupted when the current to the vacuum motor (96) drops to a fixed percentage over a period of time from normal operating levels indicating the path of the air in the vacuum assembly has been blocked.

21 Claims, 2 Drawing Sheets

SHUTOFF CONTROL METHODS FOR SURFACE TREATING MACHINES

BACKGROUND

The present invention relates generally to motor control methods and particularly to automatic methods for shutting off motors under various operating conditions encountered in the operation of floor cleaning machines.

A floor cleaning machine for cleaning large floor areas as in hotels, offices and the like will typically include two motors. A first motor 60, sometimes referred to as a brush motor, is coupled to a rotating agitator 64 which contacts the surface to be treated or cleaned. A second motor 96, sometimes referred to as a vacuum motor, is coupled to an air moving device 94 for creating directional air flow so as to remove cleaning solutions and/or debris from the surface being cleaned and placing the picked up solution and/or debris into a recovery vessel such as a tank 90.

One type of floor cleaning machines for which the present invention has particular application is a floor scrubber 10. In floor scrubbers, the rotating agitator 64 can be in the form of a brush. However, due to the particular floor surface to be cleaned or the particular cleaning operation desired to be performed, the rotating agitator 64 often is in the form of a pad 164 held on a pad holder 166 by a retainer 168. To maximize pad life and for maximum cleaning ability, it is desirable to invert the pad 164 on the pad holder 166 on occasion. Floor scrubbers 10 include some provisions for moving the agitator 64 between a raised and lowered position. In the lowered position, the agitator 64 is in its working position and engages the floor surface. In the raised position, the rotating agitator 64 is in a transport position elevated from the floor surface at least for ease of transport between cleaning surfaces or between its storage location and the surface desired to be cleaned. Typically, such provisions are in the form of a lift lever 56 which is pivoted by the foot of the operator. The brush motor 60 is controlled by an electric switch on the console of the floor scrubber 10. When the operator desired to invert the pad 164, the operator would move the lift lever 56 to raise the rotating agitator 64 off the floor to obtain access to the retainer 168 of the pad 164. However, the operator often forgot to turn off the electric switch controlling the brush motor 60. As the pad 164 and retainer 168 are positioned on the underside of the floor scrubber 10, visibility may be limited or otherwise restricted. Thus, injury to the operator may occur if the operator attempts to remove the retainer 168 and pad 164 without realizing the agitator 64 is still rotating.

Thus, a need exists to automatically shut off the brush motor 60 when the rotating agitator 64 is raised off the floor surface at least for safety reasons.

Also, it is clearly desirable to prevent solution from passing from the recovery tank 90 into the air moving device 94. One prior attempt to solve this problem was to provide a float operated mechanical switch in the recovery tank 90. However, at least due to the exposure of such switches to moisture in the recovery tank, reliability issues have arisen. Additionally, problems also occur (especially when the recovery tank 90 is close to being full but not full enough to turn off the mechanical switch) of the cleaning solution sloshing through the outlet of the recovery tank and being drawn into the air moving device 94. Thus, a preferred method of solving this problem is to provide a mechanical float 170 which shuts off the outlet of the recovery tank 90 and thus blocks fluid communication between the recovery tank 90 and the air moving device 94. The problem is that when the recovery tank 90 is full and the mechanical float 170 blocks off the outlet of the recovery tank 90, the vacuum motor 96 continues to drive the air moving device 94 but the cleaning solution and/or debris are not removed from the floor surface as air flow is blocked. However, the operator may not realize this has occurred until cleaning solution being pushed in front of the squeegee provisions 144 is visible beyond the sides of scrubber 10 or behind scrubber 10. Although the sound or pitch of the air moving device 94 may change when the air flow is blocked, the operator may not notice this change due to lack of attention or other distractions and can especially be difficult to ascertain when floor scrubbers 10 are designed and manufactured to reduce or deaden noise generation.

Thus, a need exists to automatically shut off the vacuum motor 96 when the air flow through the air moving device 94 is blocked such as when the recovery vessel such as a recovery tank 90 is full of solution and/or debris.

SUMMARY

The present invention solves these needs and other problems in the field of surface treating machines by providing, in the preferred form, methods and apparatus for interrupting operation of the vacuum motor of a vacuum assembly when the path of the air within the vacuum assembly is detected as being blocked. In most preferred forms of the present invention, the vacuum assembly is of the wet type and the vacuum motor operation is interrupted when the mechanical float in the recovery tank blocks fluid communication between the recovery tank and the fan or other air moving device.

In other aspects of the present invention, the present invention provides methods and apparatus for interrupting operation of the brush motor when the agitator is detected as being in a raised position after the operator has had an opportunity to move the agitator to its lowered position and in the most preferred form only after the agitator has in fact been moved to and operated in its lowered position.

It is thus an object of the present invention to provide novel methods and apparatus for controlling operation of motors in a surface treating machine.

It is further an object of the present invention to provide such novel control methods and apparatus for automatically interrupting operation of surface treating machine motors in the event the loads to the motor are reduced from normal operating levels.

It is further an object of the present invention to provide such novel control methods and apparatus for automatically shutting off the brush motor when the agitator driven thereby is detected as being raised off the surface.

It is further an object of the present invention to provide such novel control methods and apparatus for automatically shutting off the vacuum motor when the recovery vessel is full of solution and/or debris.

It is further an object of the present invention to provide such novel control methods and apparatus for automatically shutting off the vacuum motor when the air flow path through the vacuum assembly is detected as being blocked other than momentarily.

It is further an object of the present invention to provide such novel control methods and apparatus providing added operational convenience for the operator.

It is further an object of the present invention to provide such novel control methods and apparatus reducing the risk of accidental injury to the operator when servicing the agitator.

It is further an object of the present invention to provide such novel control methods and apparatus maximizing run time of a battery operated surface treating machine.

It is further an object of the present invention to provide such novel control methods and apparatus reducing wide spread splashing of solution by the agitator when raised from the surface being cleaned.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
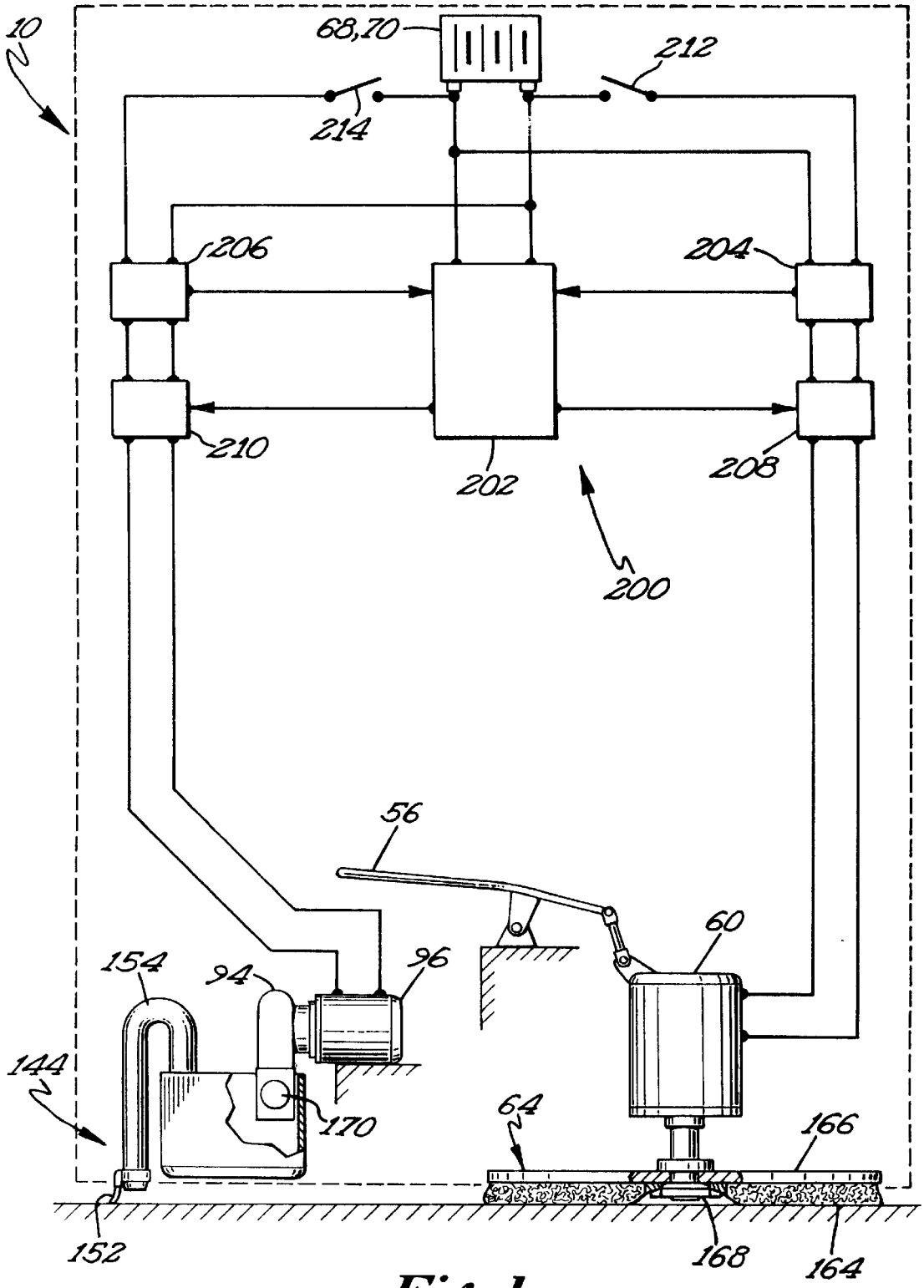
FIG. 1 shows a diagrammatic view of a floor surface treating machine in the form of a floor scrubber including an apparatus for controlling operation of motors of the floor scrubber according to preferred methods of the present invention.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "first", "second", "horizontal", "vertical", and similar terms are used herein, it should be understood that these terms have reference only to the structure shown in the drawings as it would appear to a person viewing the drawings and are utilized only to facilitate describing the illustrative embodiment.

Description

An apparatus for automatically stopping operation of vacuum motor 96 in a vacuum assembly and of brush motor 60 under various operating conditions of a floor surface treating machine according to the preferred methods of the present invention is generally shown in the drawings and generally designated 200. For purposes of explanation, the most preferred form of apparatus 200 will be set forth in connection with floor scrubber 10 of the type set forth in the BACKGROUND which is hereby incorporated herein by reference. Additionally, in the most preferred form, floor scrubber 10 is in the form shown and described in U.S. patent application Ser. No. 08/731,658. For purpose of explanation of the basic teachings of the present invention, the same numerals designate the same and similar parts in FIG. 1 hereof and the Figures of U.S. patent application Ser. No. 08/731,658. The description of the common numerals and scrubber 10 may be found herein and in U.S. patent application Ser. No. 08/731,658, which is also hereby incorporated herein by reference.

Apparatus 200 according to the teachings of the present invention includes provisions for interrupting operation of brush motor 60 when rotating agitator 64 is detected as being in the raised position and in the preferred form operation of brush motor 60 is interrupted only after agitator 64 has been rotatably engaged with the floor surface and then moved to its raised position. Apparatus 200 includes a control circuit 202 formed by analog, digital, or microprocessor type circuits and in the most preferred form includes a microcontroller along with associated discrete devices. Additionally, apparatus 200 includes first and second devices 204 and 206 for sensing operating conditions of motors 60 and 96, respectively, with control circuit 202 monitoring the operating conditions sensed by devices 204 and 206. In the preferred form, devices 204 and 206 sense the current to motors 60 and 96 and can be in the form of current coils or fixed resistance devices such as shunts and in the most preferred form are specific lengths of wire. Further, apparatus 200 includes first and second devices 208 and 210 for interrupting operation of motors 60 and 96, respectively, with control circuit 202 controlling the operation of devices 208 and 210. In the preferred form, devices 208 and 210 may be electronic or electromechanical and in the most preferred form are in the form of relays.

Figure 2:
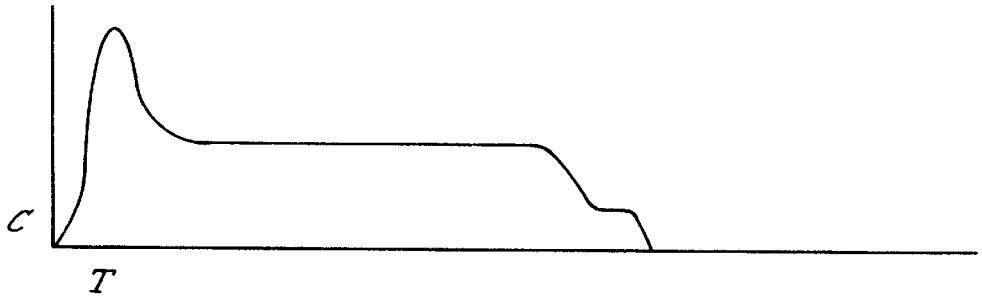
FIGS. 2–5 show graphs illustrating different operating conditions monitored over time with the apparatus of FIG. 1.

Now that the basic construction of floor scrubber 10 and apparatus 200 of the most preferred form has been set forth, the operation of apparatus 200 according to the preferred teachings of the present invention and some of the advantages obtained thereby will be explained. Specifically, when power is applied from batteries 68, 70 to control circuit 202, control circuit 202 turns interrupting devices 208 and 210 off and removes power to brush and vacuum motors 60 and 96. In the control of brush motor 60, the operator activates a switch 212 on the console of floor scrubber 10 which causes control circuit 202 to turn interrupting device 208 on and thus supplying power from batteries 68, 70 to brush motor 60. After a short delay to allow the inrush starting current to motor 60 to subside, control circuit 202 will begin monitoring the current to motor 60 for a level in excess of a threshold level. This threshold level will depend upon the particular motor 60 utilized and in the preferred form is approximately 6 amperes. It can then be appreciated that motor 60 can be activated with agitator 64 either in a raised or lowered position. With agitator 64 in the lowered position and as diagramatically shown in FIG. 2, the current to motor 60 after the inrush starting current will be at a level greater than the threshold level and which in the preferred form is equal to or greater than approximately 7 amperes. With the level of current to motor 60 being greater than the threshold level, interrupting device 208 is on and continues to allow power from batteries 68, 70 to brush motor 60. However, in the event that lift lever 56 is moved to move agitator 64 from the lowered position to the raised position so that agitator 64 is spaced from the floor surface, the current level to motor 60 will drop to the threshold level. When the current level to motor 60 reaches the threshold level, sensing device 204 provides an electronic signal to control circuit 202 which turns interrupting device 208 off and removes power to brush motor 60 and thereby stops rotation of agitator 64. Interrupting device 208 remains off until switch 212 is activated again.

Figure 3:
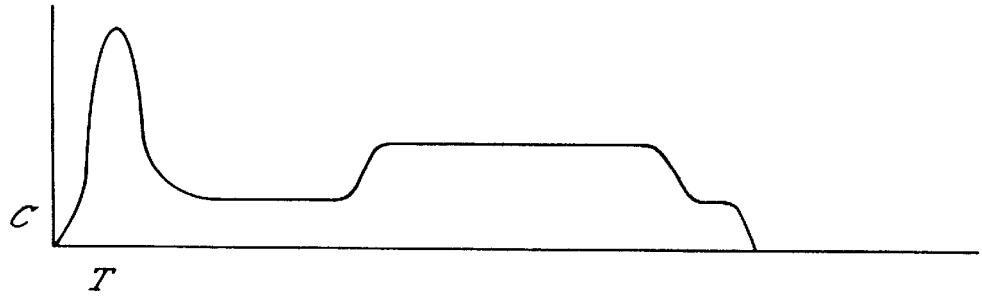

Similarly, with agitator 64 in the raised position when motor 60 is first activated and as diagrammatically shown in FIG. 3, the current to motor 60 after the inrush starting current will be at or below the threshold level and which in the preferred form is approximately 6 amperes. Although the current may be at the threshold level, interrupting device 208 remains on and continues to allow power from batteries 68, 70 to brush motor 60 as the current level has not exceeded the threshold level aside from the inrush starting current.

The operator moves lift lever 56 to move agitator 64 from its raised to its lowered position while it is being rotated by motor 60 so that agitator 64 engages the floor surface. When agitator 64 engages the floor surface, the current to motor 60 will exceed the threshold level which in the preferred form is equal to or greater than approximately 7 amperes. With the level of current to motor 60 being greater than the threshold level, interrupting device 208 is on and continues to allow power from batteries 68, 70 to brush motor 60. However, in the event that lift lever 56 is moved to move agitator 64 from the lowered position to the raised position so that agitator 64 is spaced from the floor surface, the current level to motor 60 will drop to the threshold level. When the current level to motor 60 reaches the threshold level, sensing device 204 provides an electronic signal to control circuit 202 which turns interrupting device 208 off and removes power to brush motor 60 and thereby stops rotation of agitator 64. Interrupting device 208 remains off until switch 212 is activated again.

It should be appreciated that the automatic shut off of brush motor 60 when agitator 64 is moved to its raised position according to the teachings of the present invention is advantageous for several reasons. First, the risk is greatly reduced of injury to the operator resulting from the operator not realizing that agitator 64 is rotating when it was desired to service agitator 64. Specifically, if floor scrubber 10 is being operated to clean a floor surface and the operator decides to service agitator 64 such as inverting pad 164, the operator will move lift lever 56 to raise agitator 64 from its lowered position to its raised position to allow access to agitator 64. It can then be appreciated that as soon as agitator 64 is raised, the current to motor 60 drops to the threshold level so that interrupting device 208 turns off and interrupts power to motor 60 and stopping rotation of agitator 64. Thus, the operator forgetting to turn off motor 60 when desired to service agitator 64 is less likely to occur. Additionally, the automatic shut off of brush motor 60 when agitator 64 is moved to its raised position is advantageous for operation convenience for the operator as a separate operation step is not required to turn off motor 60 such as moving switch 212 in addition to moving lift lever 56. Further, the automatic shut off of brush motor 60 when agitator 64 is moved to its raised position also maximizes run time of batteries 68, 70 as motor 60 generally does not run in the raised position. Furthermore, the automatic shut off of brush motor 60 when agitator 64 is moved to its raised position reduces splashing. Specifically, agitator 64 has a tendency to retain solution when raised from the floor surface which tends to be released by agitator 64 and propelled as a result of circumferential forces outwardly due to the rotation of agitator 64. When agitator 64 is not rotating, the circumferential forces do not exist and there is less tendency of the solution to be released from agitator 64. Further, if released from agitator 64 which is not rotating, the solution will simply drip from the agitator 64 downwardly and is more likely to be retained by the side wipers and squeegee provisions 144 than if the solution is thrown outwardly from the rotation of agitator 64.

It should be appreciated that the reason that apparatus 200 of the present invention does not stop rotation of agitator 64 until after the current level sensed by device 204 has exceeded the threshold level is to allow the operator the opportunity to activate motor 60 while agitator 64 is in the raised position and to lower the agitator 64 to its lowered position after it is rotating. In the most preferred form, monitoring of the current level to motor 60 does not occur until after agitator 64 has been in fact lowered to its lowered position and the current level to motor 60 has exceeded the threshold level (aside from the inrush current associated with starting motor 60). However, according to the teachings of the present invention, apparatus 200 could begin to monitor the current level to motor 60 after a predetermined time has elapsed from the start of activation of motor 60. This predetermined time would be sufficient to allow at least an average operator an opportunity to move lift lever 56 from its raised position to its lowered position after activation of switch 212. Thus, if the operator forgets to lower agitator 64 after motor 60 has been activated, apparatus 200 will automatically turn off motor 60 after the passage of the predetermined time.

In the control of vacuum motor 96, the operator activates a switch 214 on the console of floor scrubber 10 which causes control circuit 202 to turn interrupting device 210 on and thus supplying power from batteries 68, 70 to vacuum motor 96. After a short delay to allow the inrush starting current to motor 96 to subside, control circuit 202 will begin monitoring the current to motor 96. It should then be noted that an air flow path exists from the inlet of squeegee assembly 152 for wiping the floor surface and through hose 154 and into the inlet of recovery tank 90. From recovery tank 90 and assuming that the level of solution in recovery tank 90 is such that mechanical float 170 does not block the outlet of recovery tank 90 and the inlet to air moving device 94, the air flow path exists from the interior of recovery tank 90 and through air moving device 94 and the outlet thereof. With the path being unobstructed, motor 96 will rotate air moving device 94 for removing air from recovery tank 90 and causing air to be drawn through the inlet of recovery tank 90, hose 154, and the inlet of squeegee assembly 152. Solution and/or debris from the surface to be cleaned is picked up and carried by the air and deposited in the recovery tank 90 before the air exits the outlet of recovery tank 90. With the path being unobstructed, motor 96 will draw a level of current from batteries 68, 70, with the level being dependent upon several factors including but not limited to the voltage of batteries 68, 70, the type of floor surface being cleaned, and the specific conditions of squeegee provisions 144. However, if the path from the inlet of squeegee assembly 152 to the outlet of air moving device 94 should become blocked, air is unable to flow through the path and the force required to rotate air moving device 94 decreases. Thus, motor 96 will draw a level of current from batteries 68, 70 which is less than the level of current when the air flow path is not blocked.

Figure 4:
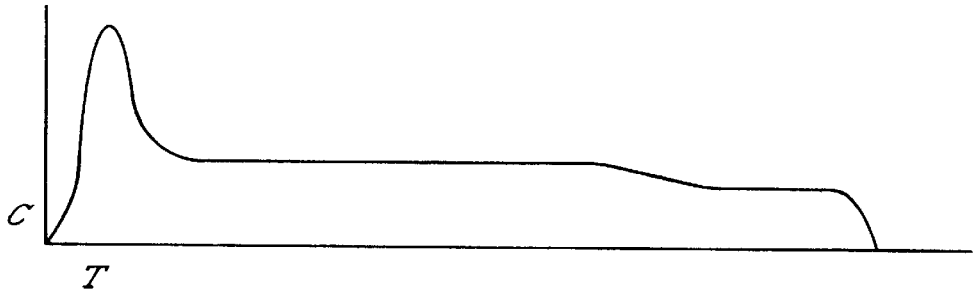

According to the teachings of the present invention and as diagrammatically shown in FIG. 4, device 206 detects the level of current to motor 96. Control circuit 202 monitors the current detected by device 206 and turns device 210 off and thereby shutting off vacuum motor 96 in the event that the level of current drops to a fixed percentage over a fixed period of time. The fixed period of time can be determined by timing how long it takes for the current level to drop to its minimum level once the inlet to squeegee assembly 152 is intentionally blocked and in the preferred form is 4 seconds. Likewise, the fixed percentage can be determined by measuring the current to vacuum motor 96 with a normal, unblocked air flow path and a blocked air flow path such as by intentionally blocking the inlet to squeegee assembly 152 and in the preferred form is 84%.

Figure 5:
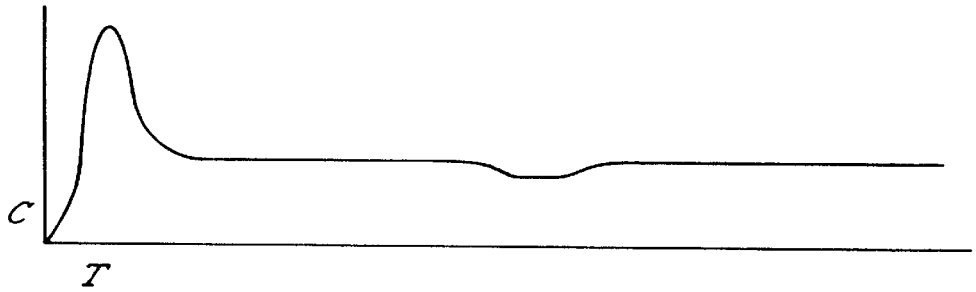

It should be appreciated that the time delay also does not result in turning off power to vacuum motor 96 in the event that the inlet to squeegee assembly 152 becomes momentarily restricted in normal use. Specifically, as diagrammatically shown in FIG. 5, the level of current drawn by motor 96 will drop (potentially even to the fixed percentage level) in the event that the inlet to squeegee assembly 152 becomes momentarily blocked. However, if the blockage lasts less than the fixed period of time, the level of current drawn by motor 96 will increase to normal levels when the blockage is removed and power will continue to be supplied to motor 96. In the preferred form, the shut off of vacuum motor 96 is controlled by monitoring for a relative drop in current rather than a fixed threshold as in the automatic shut off of brush motor 60 because of the relatively low levels of current to vacuum motor 96 as compared to brush motor 60 and the variable level of current to vacuum motor 96 under various operating conditions.

In normal operation, the air flow path would be blocked whenever the level of the solution in recovery tank 90 is such that mechanical float 170 will block the outlet of recovery tank 90 and the inlet to air moving device 94. Thus, the operator will generally become immediately aware that recovery tank 90 is full because vacuum motor 96 will stop resulting in a change in the sound of floor scrubber 10 which should be readily ascertainable and/or because of a light on the console of floor scrubber 10 providing a visible indication. However, in addition to stopping vacuum motor 96 in the event that recovery tank 90 is full, the operation of vacuum motor 96 will be interrupted when a blockage occurs in the path of the air (other than for a momentary restriction) including but not limited to when the inlet of squeegee assembly 152 becomes blocked.

It should be appreciated that although apparatus 200 has been explained in connection with a wet type vacuum assembly according to the teachings of the present invention, apparatus 200 can have application in other types of vacuum assemblies. As an example, the operation of vacuum motor 96 could be interrupted in the path of air through the vacuum assembly such as the result of clogging the filters or filter bags in a particulate vacuum assembly and similarly would protect air moving device 94 and vacuum motor 96 therein.

In the most preferred form, control circuit 202 can also monitor motors 60 and 96 for abnormally high levels of current. specifically, control circuit 202 can be programmed to act like a circuit breaker in that the time before interrupting devices 208 and 210 are turned off can depend on the severity of the overload condition. For example, if motor 60 or 96 is only slightly overloaded, apparatus 200 can allow the overloaded motor 60 or 96 to run for a period of time such as 10 minutes before corresponding device 208 and 210 is turned off. However in the event of a severe overload such as in the case of a locked agitator 64 or air moving device 94, the corresponding motor 60 and 96 would be automatically shut off almost instantly. Further, control circuit 202 can also include provisions for shutting off motors 60 and 96 in the event that the voltage of batteries 68, 70 becomes low or in the event that floor scrubber 10 tilts beyond a fixed angle from a normal operating position such as in the event that scrubber 10 is tilted to obtain access to agitator 64.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A vacuum assembly comprising, in combination: a recovery vessel; an air moving device in fluid communication with the recovery vessel for removing air from the recovery vessel; a vacuum motor coupled to the air moving device; an inlet to the recovery vessel allowing the entry of air into the recovery vessel, with the air flowing in a path through the inlet, the recovery vessel, and the air moving device; and means for detecting a blockage in the path of the air and interrupting operation of the vacuum motor; wherein the detecting means monitors the current level to the vacuum motor and interrupts the current to the vacuum motor when the current level drops to a fixed percentage over a fixed period of time.

2. The vacuum assembly of claim 1 wherein the detecting means interrupts operation of the vacuum motor after a time delay so that the vacuum motor will not be inadvertently shut off if the path of the air is momentarily restricted.

3. A vacuum assembly comprising, in combination: a recovery vessel; an air moving device in fluid communication with the recovery vessel for removing air from the recovery vessel; a vacuum motor coupled to the air moving device; an inlet to the recovery vessel allowing the entry of air into the recovery vessel, with the air flowing in a path through the inlet, the recovery vessel, and the air moving device; and means for detecting a blockage in the path of the air and interrupting operation of the vacuum motor; wherein the detecting means interrupts operation of the vacuum motor after a time delay so that the vacuum motor will not be inadvertently shut off if the path of the air is momentarily restricted.

4. The vacuum assembly of claim 3 wherein the recovery vessel is a tank for holding solutions; and wherein the vacuum assembly further comprises, in combination: a mechanical float for blocking fluid communication between the recovery vessel and the air moving device.

5. The vacuum assembly of claim 4 wherein the inlet includes a squeegee assembly for wiping a surface to be treated and a hose extending and in fluid communication between the inlet of the recovery tank and the squeegee assembly.

6. The vacuum assembly of claim 3 wherein the detecting means monitors the current level to the vacuum motor and interrupts the current to the vacuum motor when the current level drops to a fixed percentage over a fixed period of time.

7. A surface treating machine comprising, in combination: an agitator for contacting the surface to be treated; a brush motor coupled to the agitator for rotating the agitator; means for moving the agitator between a raised position and a lowered position, with the agitator being elevated from the surface in the raised position and engaging the surface in the lowered position; and means for detecting that the agitator is in the raised position and interrupting operation of the brush motor after an opportunity to move the agitator to the lowered position.

8. The surface treating machine of claim 7 wherein the detecting means interrupts operation of the brush motor only after the brush motor has rotated the agitator in the lowered position.

9. The surface treating machine of claim 7 wherein the brush motor exhibits a first operating condition when the agitator is in the lowered position and is being rotated by the brush motor while engaged with the surface and exhibits a second operating condition when the agitator is in the raised position and is rotated by the brush motor while elevated from the surface, with the detecting means detecting the second operating condition.

10. The surface treating machine of claim 9 wherein the current to the brush motor in the first operating condition is above a threshold level; and wherein the detecting means detects when the current to the brush motor is equal to or less than the threshold level.

11. A vacuum method comprising the steps of: providing a recovery vessel having an inlet allowing the entry of air into the recovery vessel; removing air from the recovery vessel by an air moving device in fluid communication with the recovery vessel and coupled to a vacuum motor, with the air flowing in a path through the inlet, the recovery vessel, and the air moving device; and detecting a blockage in the path of the air and interrupting operation of the air moving device comprising the step of monitoring the current level to the vacuum motor and interrupting the current to the vacuum motor when the current level drops to a fixed percentage over a fixed period of time.

12. The vacuum method of claim 11 wherein the detecting step comprises the step of interrupting operation of the air moving device after a time delay so that the air moving device will not be inadvertently shut off if the path of the air is momentarily restricted.

13. A vacuum method comprising the steps of: providing a recovery vessel having an inlet allowing the entry of air into the recovery vessel; removing air from the recovery vessel by an air moving device in fluid communication with the recovery vessel, with the air flowing in a path through the inlet, the recovery vessel, and the air moving device; and detecting a blockage in the path of the air and interrupting operation of the air moving device after a time delay so that the air moving device will not be inadvertently shut off if the path of the air is momentarily restricted.

14. The vacuum method of claim 13 wherein the recovery vessel providing step comprises the step of providing a tank for holding solutions; and wherein the vacuum method further comprises the step of: providing a mechanical float for blocking fluid communication between the recovery vessel and the air moving device.

15. The vacuum method of claim 14 further comprising the steps of: providing a squeegee assembly for wiping a surface to be treated; and providing a hose extending and in fluid communication between the inlet of the recovery tank and the squeegee assembly.

16. The vacuum method of claim 13 wherein the air removing step comprises the step of removing air by the air moving device coupled to a vacuum motor; and wherein the detecting step comprises the step of monitoring the current level to the vacuum motor and interrupting the current to the vacuum motor when the current level drops to a fixed percentage over a fixed period of time.

17. A method for treating a surface comprising the steps of: providing an agitator for contacting the surface to be treated; providing a brush motor coupled to the agitator for rotating the agitator; moving the agitator between a raised position and a lowered position, with the agitator being elevated from the surface in the raised position and engaging the surface in the lowered position; and detecting that the agitator is in the raised position and interrupting operation of the brush motor after an opportunity to move the agitator to the lowered position.

18. The surface treating method of claim 17 wherein the detecting step comprises the step of interrupting operation of the brush motor only after the brush motor has rotated the agitator in the lowered position.

19. The surface treating method of claim 17 wherein the brush motor providing step comprises the step of providing the brush motor exhibiting a first operating condition when the agitator is in the lowered position and is being rotated by the brush motor while engaged with the surface and exhibiting a second operating condition when the agitator is in the raised position and is rotated by the brush motor while elevated from the surface, with the detecting step comprising the step of detecting the second operating condition.

20. The surface treating method of claim 19 wherein the detecting step comprises the step of detecting when the current to the brush motor is equal to or less than a threshold level, with the current to the brush motor in the first operating condition being above the threshold level.

21. A surface treating machine comprising, in combination: an agitator for contacting the surface to be treated; a brush motor coupled to the agitator for rotating the agitator; means for moving the agitator between a raised position and a lowered position, with the agitator being elevated from the surface in the raised position and engaging the surface in the lowered position; means for detecting that the agitator is in the raised position and interrupting operation of the brush motor after an opportunity to move the agitator to the lowered position; and a vacuum assembly comprising, in combination: a recovery vessel; an air moving device in fluid communication with the recovery vessel for removing air from the recovery vessel; a vacuum motor coupled to the air moving device; an inlet to the recovery vessel allowing the entry of air into the recovery vessel, with the air flowing in a path through the inlet, the recovery vessel, and the air moving device; and means for detecting a blockage in the path of the air and interrupting operation of the vacuum motor.

* * * * *